United States Patent [19]

Yanabu et al.

[11] 4,246,458

[45] Jan. 20, 1981

[54] VACUUM INTERRUPTER

[75] Inventors: Satoru Yanabu, Yokohama; Tohoru Tamagawa, Chigasaki; Shigeo Souma, Tokyo; Takumi Funahashi, Yokohama; Hiroyuki Okumura, Chigasaki; Nobuyuki Takahashi, Kawasaki, all of Japan

[73] Assignee: Tokyo Shibaura Denki Kabushiki Kaisha, Kanagawa, Japan

[21] Appl. No.: 893,401

[22] Filed: Apr. 4, 1978

[51] Int. Cl.[3] ..... H01H 33/66

[52] U.S. Cl. ..... 200/144 B

[58] Field of Search ..... 200/144 B

[56] References Cited

U.S. PATENT DOCUMENTS 3,935,406 1/1976 Murano et al. ..... 200/144 B 3,946,179 3/1976 Murano et al. ..... 200/144

4,079,219 3/1978 Weston ..... 200/144 B

FOREIGN PATENT DOCUMENTS 52-128569 10/1977 Japan ..... 200/144 B

*Primary Examiner*—Robert S. Macon

*Attorney, Agent, or Firm*—Stevens, Davis, Miller & Mosher

[57] ABSTRACT

In a vacuum interrupter of the type comprising a vacuum vessel and a pair of separable main electrodes located in the vacuum vessel, at least one of the main electrodes being provided with a coil electrode for generating an axial magnetic field, the vacuum interrupter further comprises a flat annular intermediate electrode disposed between the main electrodes and provided with an opening at its center through which one of the main electrodes passes.

2 Claims, 14 Drawing Figures

VACUUM INTERRUPTER

BACKGROUND OF THE INVENTION

This invention relates to an improved vacuum interrupter and more particularly, a vacuum chamber of a vacuum interruptor provided with electrodes for high voltage use.

It is well known that in a vacuum interrupter, current is interrupted by separating a pair of separable electrodes under high vacuum condition of at least below $10^{-4}$ Torr possessing excellent insulating property and arc extinguish property.

FIG. 1 shows a conventional vacuum interrupter, in which open ends of an insulating cylinder 1 are sealed by end plates 2 and 3 to define an air-tight chamber. The air in the chamber is exhausted to creat a vacuum condition of below $10^{-4}$ Torr. In the vacuum chamber, a stationary rod 5 supporting a stationary electrode 4 is supported by the end plate 2 and a movable electrode 6 is disposed to oppose the stationary electrode 4. The movable electrode 6 is secured to a movable rod 7 connected to operating means, not shown, and a metal bellows 8 is air-tightly connected to the movable rod 7 at its one end and to the end plate 3 at the other end so that the vacuum interrupter operates in the chamber maintained at a proper vacuum condition.

An electrostatic shield 9 is secured to the cylinder 1 so as to surround the electrodes 4 and 6 in the vacuum chamber. The shield 9 serves to prevent the lowering of the insulating strength of the inner surface of the cylinder 1 caused by the deposition of metal vapor generated from the electrode due to arc created at the time of the current interruption.

In such vacuum interrupter, the electrodes 4 and 6 are in contact with each other at the closed state and when the movable rod 7 is moved downwardly (in FIG. 1) by the action of the operating means, the movable electrode 6 separates from the stationary electrode 4 and then arc is created across both electrodes. The arc is sustained by metal vapor generated from a cathode, for example, electrode 6, and when the current decreases to zero point, the generation of the metal vapor stops. Thus, it becomes impossible to sustain the arc and the circuit is interrupted.

When a large current is interrupted, unstable arc is generated across the electrodes 4 and 6 by the interaction between a magnetic field generated by the arc itself and a magnetic field created by an external electric circuit. For this reason, the arc moves across the electrode surface towards the both ends or the periphery of the electrode and overheats locally the ends or the periphery, and since a large quantity of metal vapor is evolved, the degree of the vacuum in the chamber is lowered and the interrupting capability is also lowered. It is considered that these adverse phenomena are caused for the reason that the metal vapor or ionized metal vapor escapes outwardly of the electrodes and ions required for sutaining the arc becomes insufficient during the arc generation, thereby causing unstable the arc.

In order to prevent such adverse phenomena, it has been well known to apply a magnetic field to the electrode surface, and actually, as examples for applying the magnetic field in the prior art, (1) a coil 100 is disposed around the outer periphery of the insulating cylinder 1 of the vacuum interrupter, and the current to be interrupted is passed through the coil 100 for generating the magnetic field in a direction vertical to the electrode surface (FIG. 1), and (2) the structure of the electrode is reformed so as to create a strong axial magnetic field by the electrode itself as shown in FIGS. 2(a) through 2(c) without enlarging the vacuum interrupter. The concrete construction of the electrode shown in FIGS. 2(a) through 2(c) is described hereafter with reference to FIGS. 4(a) and 4(b).

However, in the example (1), since the coil 100 is positioned considerably apart from the electrodes 4 and 6, it is difficult to generate sufficiently strong axial magnetic field on the electrode surface and in order to obtain an effective magnetic field the coil must be enlarged and the whole structure of the vacuum interrupter is also enlarged. On the other hand, in the example (2), it is not necessary to enlarge the whole structure of the vacuum interrupter as in the example (1), but in a vacuum interrupter for high voltage use, in order to apply a strong axial magnetic field it is required to sufficiently separate the electrodes 4 and 6.

SUMMARY OF THE INVENTION

Therefore, it is an object of this invention to provide an improved vacuum interrupter for high voltage use having electrodes capable of generating strong axial magnetic field for the arc generated.

According to this invention, there is provided a vacuum interrupter of the type comprising a vacuum vessel and a pair of separable main electrodes located in the vacuum vessel and at least one of the main electrodes is provided with a coil electrode for generating an axial magnetic field. The vacuum interrupter comprises a flat annular intermediate electrode disposed between the main electrodes and provided with an opening at its center through which one of the main electrode passes.

DESCRIPTION OF THE PREFERRED EMBODIMENTS

Figure 1:
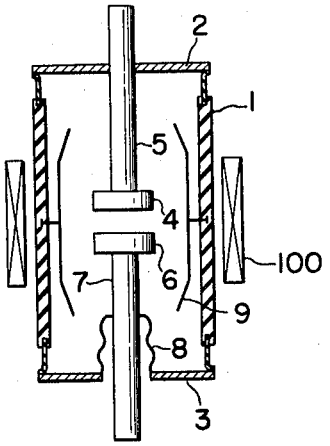
FIG. 1 PRIOR ART
FIG. 1 shows a vertical cross sectional view showing a prior art vacuum interrupter provided with a coil for generating an axial magnetic field.
Figure 2A:
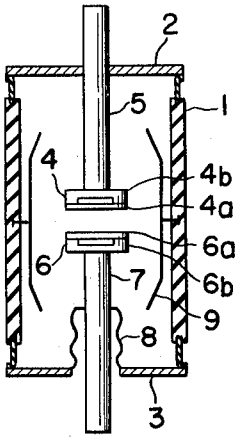
FIG. 2(a) PRIOR ART
FIG. 2(a) shows a vertical cross sectional view showing a prior art vacuum interrupter provided with electrodes for generating an axial magnetic field.
Figure 2B:
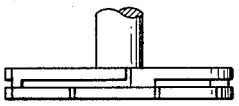
FIG. 2(b) PRIOR ART
FIGS. 2(b) and 2(c) show side and plan views of one of the electrodes shown in FIG. 2(a)
Figure 2C:
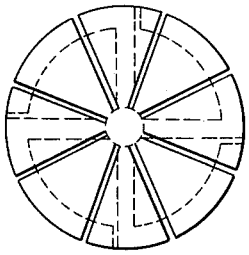
FIG. 2(c) PRIOR ART
Figure 3A:
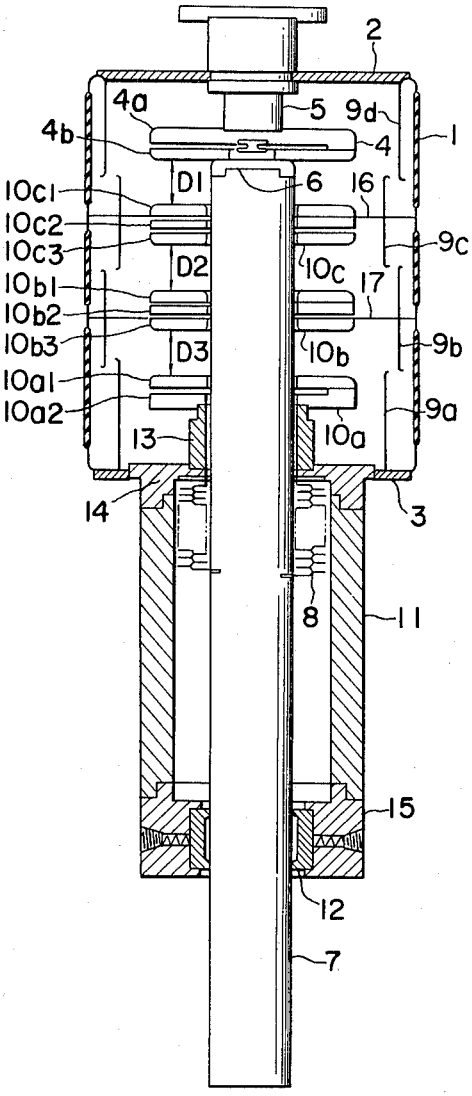
FIGS. 3(a) and 3(b) show vertical cross sectional views of one embodiment of a vacuum interrupter according to this invention at closed and open states, respectively.
Figure 3B:
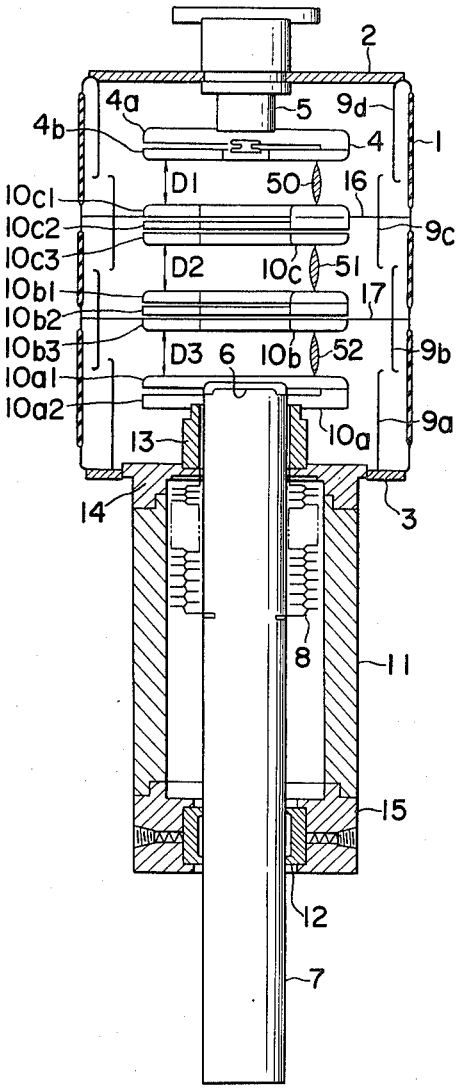

Referring to FIGS. 3(*a*) and 3(*b*), an insulating cylinder 1 constituting a vacuum chamber is made of an insulating material, and air or gas in the chamber is sufficiently exhausted to creat and maintain high vacuum condition.

In the illustrated embodiment, a pair of separable main electrodes 4 and 6 are disposed in the vacuum chamber and flat disc type annular electrodes 10*a*, 10*b* and 10*c* are also disposed coaxially and parallely with the main electrodes therebetween.

Figure 4A:
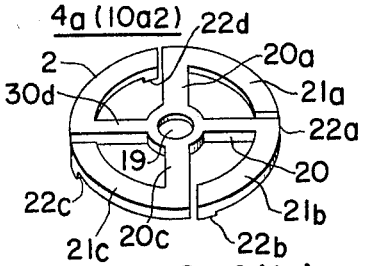
FIGS. 4(a), 4(b) and FIGS. 5(a), 5(b) and 5(c) show in detail flat type hollow electrodes shown in FIGS. 3(*a*) and 3(*b*)
Figure 4B:
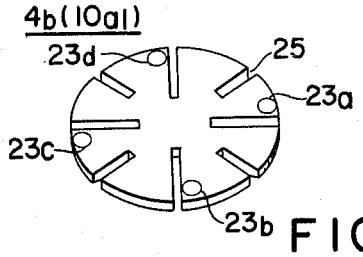

One of the main electrodes, for example electrode 4 in this embodiment, is secured to the lower end of a stationary rod 5, and the electrode 4 comprises a coil electrode 4*a* and a contact electrode 4*b* as shown in FIGS. 4(*a*) and 4(*b*). The coil electrode 4*a* comprises arms 20*a*, 20*b*, 20*c* and 20*d* radially extending from a portion defining a central annular portion 19, arcuate portions 21*a*, 21*b*, 21*c* and 21*d* with one ends secured to the outer ends of the arms 20*a* through 20*d*, respectively, and projections 22*a*, 22*b*, 22*c* and 22*d* disposed at the lower side of the other or free ends of the arcuate portions 21*a* through 21*d* respectively. The contact electrode 4*b* is made of suitable electrode material for interrupting a large current and provided with a plurality of radial slits so as not to decrease the strength of the magnetic field by an eddy current. The projections 22*a* through 22*d* of the coil electrode 4*a* contact to contact points 23*a*, 23*b*, 23*c* and 23*d* of the contact electrode 4*b*, respectively.

The electrode 10*a* located at the lowermost position of the disc type hollow intermediate electrodes 10*c*, 10*b* and 10*a* has the construction similar to that of the stationary electrode 4, and particularly, in the electrode 10*a*, a coil electrode $\mathbf{10}a_2$ is connected to a contact electrode $\mathbf{10}a_1$ so that current flows to the electrode $\mathbf{10}a_2$ in the same direction as that in the electrode 4*a*. The coil electrode $\mathbf{10}a_2$ is secured to the upper end of a support member 13, the lower end of which is fitted to a support flange 14 which is connected to the movable rod 7 through a support cylinder 11 and support fittings 15 and 12. Thus, the electrode 10*a* is electrically connected to the movable rod 7 (FIGS. 3(*a*) and 3(*b*)).

The movable electrode 6 firmly secured to the movable rod 7 comprises a flat electrode, and the contact surface thereof which engage the contact electrode of the stationary electrode 4 is made of a contact material suitable for interrupting a large curent.

Figure 5A:
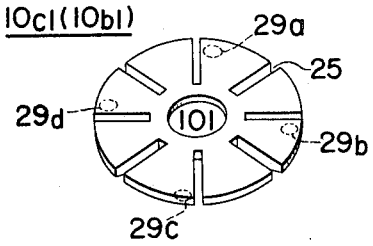
Figure 5B:
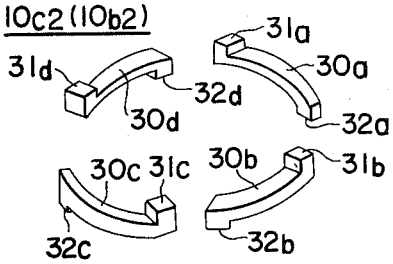
Figure 5C:
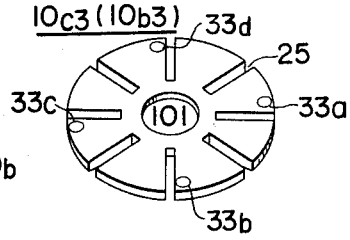

The structure of the disc type annular intermediate electrodes 10*b* and 10*c* are shown in FIGS. 5(*a*), 5(*b*) and 5(*c*), and since both electrodes 10*b* and 10*c* have the same structure, only the electrode 10*c* will be described hereunder.

The intermediate electrode 10*c* comprises contact electrodes $\mathbf{10}c_1$ and $\mathbf{10}c_3$ and a coil electrode $\mathbf{10}c_2$ interposed therebetween, and the contact electrodes are provided with central annular portions 101 through which the movable electrode can pass. On the lower surface of the electrode $\mathbf{10}c_1$ are disposed contact points 29*a*, 29*b*, 29*c* and 29*d* to be contacted to the coil electrode $\mathbf{10}c_2$ and on the upper surface of the electrode $\mathbf{10}c_3$ are disposed contact points 33*a*, 33*b*, 33*c* and 33*d*.

The coil electrode $\mathbf{10}c_2$ comprises arcuate electrodes 30*a*, 30*b*, 30*c* and 30*d* and axial projections 31*a*, 31*b*, 31*c* and 31*d*, and 32*a*, 32*b*, 32*c* and 32*d* disposed at both ends of the respective acuate electrodes which are in contact with contact points 29*a*, 29*b*, 29*c* and 29*d*, and 33*a*, 33*b*, 33*c* and 33*d*, respectively. The diameter of the coil electrode $\mathbf{10}c_2$ is of course equal to those of the contact electrodes $\mathbf{10}c_1$ and $\mathbf{10}c_3$. Thus, the disc type annular electrode 10*b* and 10*c* are constituted by contacting the projections 31*a* through 31*d* to the contact points 29*a* through 29*d* and also by contacting the projections 32*a* through 32*d* to the contact points 33*a* through 33*d*, respectively. The intermediate electrodes 10*b* and 10*c* are supported by the one ends of the support members 17 and 16 the other ends of which are secured to the inside surface of the insulating cylinder 1. Shields 9*b* and 9*c* are attached to the intermediate portions of the support members 17 and 16 in a manner that the end plates 2 and 3 and the intermediate electrodes 10*b* and 10*c* are insulated with each other.

In the illustrated embodiment, although three intermediate electrodes are located, the number of the intermediate electrodes and the distances $D_1$, $D_2$, $D_3$ . . . between the adjacent intermediate electrodes can be adjusted in accordance with the voltage rating of a circuit to be used. Furthermore, it is possible to easily transfer the generated arc to the intermediate electrodes 10*c*, 10*b* and 10*a* by using the metal fitting 12 of metal fittings 12 and 15 having a reactance slightly larger than the total reactance of the support member 13, the support flange 14, the support cylinder 11 and the fitting 15 or by inserting, for example, a reactor having a reactance larger than the total reactance mentioned above.

Thus constructed vacuum interrupter takes the closed condition in the normal operation and current flows into an external line successively through the stationary rod 5, the coil electrode 4*a*, the contact electrode 4*b*, the movable electrode 6 and the movable rod 7. In order to open the circuit, the movable rod 7 together with the movable electrode 6 is separated from the stationary electrode 4 downwardly in FIG. 3(*a*) and arc is then striken across the contact electrode 4*b* and the movable electrode 6. The arc is driven to move away from the central portion of the electrode by the action of a coil located externally or by the magnetic force generated by the arc itself, and in the final stage, arcs 50, 51 and 52 are formed as shown in FIG. 3(*b*) through the intermediate electrodes 10*c*, 10*b* and 10*a*.

When the arcs are created across the stationary electrode 4 and the intermediate electrodes 10*c*, 10*b* and 10*a*, a current flows in the arcuate electrodes, so that axial magnetic fields are generated therebetween. The arcs are driven by the magnetic fields generated. Consequently, the melting of the electrodes can be prevented by applying the magnetic fields having a strength sufficient to extinguish the arcs.

Figure 6A:
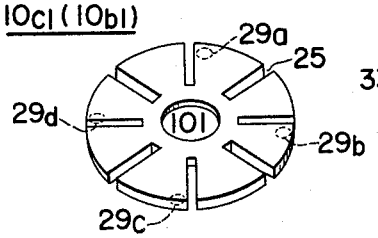
FIGS. 6(*a*), 6(*b*) and 6(*c*) show in detail flat type hollow electrodes of another embodiment of FIGS. 5(*a*) through 5(*c*).
Figure 6B:
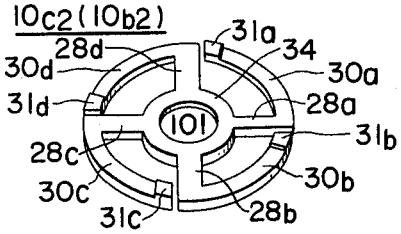
Figure 6C:
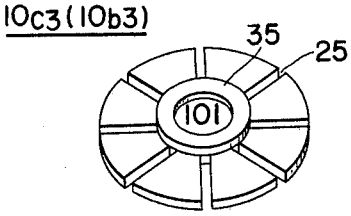

In the other example of the electrode shown in FIGS. 6(*a*), 6(*b*) and 6(*c*), the advantages similar to those mentioned above can also be obtained.

In FIGS. 6(*a*) through 6(*c*), a contact electrode $\mathbf{10}c_1$ of a disc type annular intermediate electrode 10*c* has a construction similar to that of the contact electrode $\mathbf{10}c_1$ shown in FIG. 5(*a*). The contact electrode $\mathbf{10}c_1$ shown in FIG. 6(*a*) is provided with contact points 29*a* through 29*d* for a coil electrode $\mathbf{10}c_2$ on the lower surface thereof and with a plurality of radial slits 25 so as to prevent the reduction of the magnetic field caused by an eddy current and further provided with a central annular portion 101 through which the movable electrode 6 passes. A contact electrode $\mathbf{10}c_3$ has a construction similar to that of the electrode $\mathbf{10}c_1$, but is different therefrom in that an annular contact 35 is disposed near the central annular portion 101 on the upper surface of the electrode $\mathbf{10}c_3$.

The coil electrode $\mathbf{10}c_2$ (FIG. 6(*b*)) is provided with a central annular portion 101 defined by an annular contact member 34, and arms 28*a*, 28*b*, 28*c* and 28*d* radially and outwardly extending from the contact member 34. Arcuate electrodes 30*a*, 30*b*, 30*c* and 30*d* are secured at one end respectively to the outer ends of the arms 28*a*, 28*b*, 28*c* and 28*d*, and to the free or other ends of the arcuate electrodes 30*a*, 30*b*, 30*c* and 30*d*, are mounted projections 31*a*, 31*b*, 31*c* and 31*d* so as to engage the contact points 29*a*, 29*b*, 29*c* and 29*d*, respectively. In this example of the disc type annular intermediate electrode 10c (10b), since the contact electrode 10c$_3$ (10b$_3$) engages the coil electrode 10c$_2$ (10b$_2$) at the portion near the central annular, portion 101, mechanical strength of the structure of the electrode 10c (10b) can be increased thereby preventing the deformation thereof.

As is clear from the foregoing description, according to this invention, at least one of a pair of main electrodes for generating arc thereacross is formed as an electrode provided with a current path to generate an axial magnetic field, and at least one disc type annular intermediate electrode having a construction similar to that of the one of main electrode is interposed between the main electrodes for also generating an axial magnetic field. Therefore, at least two arcs are generated in series through the intermediate electrode.

According to our experiment, it was found that when interrupting capabilities were compared between a case where one intermediate electrode is interposed between the main electrodes to generate two series arcs and a case where no intermediate electrode is used, in both cases the distance between the main electrodes being equal, the interrupting capability of the former case is considerably higher than that of the latter case. Accordingly, a vacuum interrupter for high voltage use in which arc is devided into several successive arcs can more positively to interrupt the circuit without accompanying various problems described above.

Further it should be understood by those skilled in the art that the foregoing description refers to preferred embodiments of this invention and that various modifications and changes can be made without departing from the true scope and spirit of the invention as defined in the appended claims.

What is claimed is:

1. In a vacuum interrupter of the type comprising a vacuum vessel and a pair of separable main electrodes located in said vacuum vessel, at least one of said main electrodes being provided with a coil electrode for generating an axial magnetic field, the improvement which comprises a flat annular intermediate electrode which is positioned between said main electrodes when said main electrodes are open and provided with an opening at its center through which one of said main electrodes passes, said intermediate electrode comprising two contact electrodes each having an arc sustaining surface and a current path between said contact electrodes for passing current from one of said contact electrodes to the other thereof, said current path being disposed along the peripheries of said contact electrodes and comprising a plurality of equally divided coil electrodes.

2. The vacuum interrupter according to claim 1 wherein said contact electrodes are provided with a plurality of radial slits at portions near the contact points of said coil electrode.

* * * * *